US006672128B2

(12) United States Patent
Wagner et al.

(10) Patent No.: US 6,672,128 B2
(45) Date of Patent: Jan. 6, 2004

(54) HAND TOOL IN PLIERS FORM FOR EXPANDING HOLLOW BODIES

(75) Inventors: Ewald Wagner, Bad Camberg/Würges (DE); Manfred Waltersdorf, Königstein (DE); Michael Judis, Esselbach (DE)

(73) Assignee: Rothenberger Werkeuge Aktiengesellschaft, Kelkheim (DE)

( * ) Notice: Subject to any disclaimer, the term of this patent is extended or adjusted under 35 U.S.C. 154(b) by 0 days.

(21) Appl. No.: 10/234,738

(22) Filed: Sep. 4, 2002

(65) Prior Publication Data

US 2003/0226390 A1 Dec. 11, 2003

(30) Foreign Application Priority Data

Jun. 6, 2002 (EP) ..... 02012383

(51) Int. Cl.[7] ..... B21D 41/02
(52) U.S. Cl. ..... 72/393; 72/409.01; 81/427.5
(58) Field of Search ..... 72/393, 409.01, 72/392; 81/427.5

(56) References Cited

U.S. PATENT DOCUMENTS

| | | | | | |
|---|---|---|---|---|---|
| 3,082,652 | A | * | 3/1963 | Marti | 81/427.5 |
| 4,987,763 | A | | 1/1991 | Kistner et al. | |
| 5,046,349 | A | * | 9/1991 | Velte | 72/393 |
| 5,243,845 | A | * | 9/1993 | Velte | 72/393 |
| 5,267,464 | A | * | 12/1993 | Cleland | 72/409.12 |
| 5,279,140 | A | * | 1/1994 | Blake et al. | 72/31.01 |
| 5,503,049 | A | * | 4/1996 | Chervenak et al. | 81/427.5 |
| 5,865,077 | A | * | 2/1999 | Moffitt et al. | 81/427.5 |
| 6,202,518 | B1 | * | 3/2001 | Moffitt et al. | 81/427.5 |

FOREIGN PATENT DOCUMENTS

| | | | | |
|---|---|---|---|---|
| CA | 887461 | * | 12/1971 | 72/393 |
| DE | 28 07 988 | B2 | 8/1978 | |
| DE | 40 17 404 | C | 10/1991 | |
| DE | 42 00 020 | C1 | 7/1993 | |
| DE | 690 10 980 | T2 | 2/1995 | |
| DE | 75 08 327 | U | 3/1997 | |
| DE | 0197 30 053 | C | 10/1998 | |
| EP | 0 397 570 | B1 | 11/1990 | |
| EP | 0 417 674 | B1 | 3/1991 | |
| EP | 0 619 153 | B1 | 10/1994 | |
| EP | 0 653 256 | A | 3/1995 | |
| WO | WO-01 89736 | A | 11/2001 | |

OTHER PUBLICATIONS

DER Grosse Brock Haus, p. 255 (1983).
Falbe, et al., Rompp Chemie Lexikon, 9$^{TH}$ ed., 1996, vol. H–L, p. 2479.

* cited by examiner

*Primary Examiner*—Daniel C. Crane
(74) *Attorney, Agent, or Firm*—Fulbright & Jaworski L.L.P.

(57) ABSTRACT

A hand tool for expanding hollow bodies contains a casing (2) having a laterally extending first hand lever (3). A second hand lever, (7) which consists of steel and is joined to the casing so as to pivot on a shaft (5), bears a pinion sector (6) surrounding the shaft (5). The two hand levers (3, 7) form a pliers In the casing (2) a bore is disposed for guiding a rack consisting of steel, one end of which cooperates within the bore with the pinion sector (6) such that an expansion wedge can be displaced outwardly by a closing movement of the two hand levers (3, 7). The casing has means by which an expansion head with radially moving expander jaws can be placed coaxially onto the outwardly tapered end of the spreading wedge. To reduce both the weight and the force required for operation, the casing (2) and its hand lever (3) consist of a light material from the plastic and light metal group. The casing (2) thus forms together with the rack a low-friction combination of light material and steel. Preferably the weight of the second hand lever (7) consisting with the pinion sector (6) of steel is further reduced by at least one opening **(7*d*, 7*e*, 7*g*) between the flanges (7*a*, 7*b*)**.

19 Claims, 3 Drawing Sheets

HAND TOOL IN PLIERS FORM FOR EXPANDING HOLLOW BODIES

FIELD OF THE INVENTION

The invention relates to a hand tool in the form of a pliers for expanding hollow bodies.

BACKGROUND AND SUMMARY OF THE INVENTION

In the operation of such hand tools, which embody the principle of pliers and therefore are also called expanding pliers, the procedure is to rotate the movable hand lever against the hand lever affixed to the casing and projecting approximately radially, on a circular path by an angle of about 90 degrees, so that the jaws of the expansion head contract fully, and so that these jaws can be inserted into the hollow body to be expanded, which as a rule is a pipe end. In this case the movable hand lever drives the jaws radially approximately parallel to the axis of the expansion or spreading wedge and in line with the pipe.

Starting from this ergonomically disadvantageous and tiring position, both hand levers must be squeezed together to an angular position of virtually zero, with a corresponding expenditure of effort, in order to perform the expansion process. In the case of a step-by-step expansion, this procedure must be repeated several times. In the meantime the end of each hand lever is enveloped by the fingers of each hand, and bringing the lever ends to their parallel position must be done only so far, so as to avoid pinching the fingers.

In the widening or expansion of metal pipes, the operating force, beginning from virtually zero, increases progressively. In the widening of plastic pipes or thin-walled, plastic coated metal pipes, a higher force is required at the very beginning of the widening process, i.e., precisely at an ergonomically unfavorable point. Moreover, in the case of plastic pipes a greater widening must be performed, since most plastics have a tendency to shrink back. The expansion pliers, however, must be usable for all materials and combinations thereof and, by interchanging the expansion head with other standardized expansion heads, they must be usable for different pipe diameters as well.

EP 0 397 570 B1 and the corresponding DE,690 10980 T2 have disclosed an expansion tool for pipe ends of annealed copper, in which the movable hand lever is journaled, not in the casing, but directly in the end of the expansion wedge on a first pivot pin. This hand lever is joined to the casing by a link or swing arm which is joined to the hand lever by a second pivot pin and to the casing by a third pivot pin. According to the statement of the problem, the result is that forces parallel to its axis are exerted on the expansion wedge.

But this problem cannot be solved by the stated means, for even FIG. 2 shows that the link is at a steep angle to the axis of the head toward the end of the swinging movement, and that the hand lever stresses the expansion wedge at an angle to its axis due to the first pivot pin, and this precisely at the instant of the greatest need for effort. Reason: The axes of the pivot pins are at the corners of a triangle, so that parallelograms of force must be taken into account. This also applies to the starting position according to FIG. 1. It is especially disadvantageous in this case that the expansion wedge guided in the casing protrudes especially far out from the guide with respect to the first pivot pin, namely just at a point at which the guide is especially short, because the casing has at that point a cut-out for the link and the swing arm. Thus, not only are considerable flexural forces exerted on the relatively thin expansion wedge right at the beginning, but also the latter exerts considerable edge pressure against its guide. Edge pressures—that is, line contacts—lead not only to considerable wear, but also to a greater need for effort because any lubricant film that may be present will break down under such conditions. Also, the flying three-point suspension, due to free play, does not provide for accurate guidance of the hand lever on a circular path. In the embodiment currently on the market, the casing and both hand levers consist of a light metal, so that the tool has a low weight. But this is not the only criterion for the evaluation of the known tool.

Also known are expanding pliers in which the movable hand lever is journaled directly in the casing and acts on the expansion wedge through a cam or a curve. Such tools are disclosed in EP 0 417 674 B1, but do not provide sufficient working stroke of the expansion wedge for the expansion of plastic pipes.

Relief in regard to the necessary stroke length of the expansion wedge is provided in this case by the so-called rack-and-pinion expanders, in which the inside end of the expansion wedge is in the form of a rack and is driven by a pinion sector which is on the end of the movable hand lever which is journaled on a shaft directly in the casing. It is possible to control the leverage ratio and the length of the stroke by choosing the diameter of the semicircle of the teeth in the sector. In this case, of course, tilting forces are exerted on the expansion wedge at the guide end, depending on the flank angle of the teeth, but these forces are absorbed inside of the guide or casing without edge pressure, and can be limited in their effect by an appropriate guidance diameter and lubrication.

Such a rack expander is disclosed by DE 28 07 988 B2. But in this case the pinion sector is on the side of the hand lever affixed to the casing, with the result that the expansion wedge has its greatest diameter at its free end and is tensionally stressed. Consequently the expansion wedge is arranged replaceably in an additional sleeve with external teeth and must be replaced when the expansion head is replaced. The standardized expansion heads on the market cannot be used for this purpose. Furthermore, due to the position of the pinion sector, either the length of the movable hand lever is shortened or, for a given length, the free end of the hand lever projects further away from the casing.

A rack expander of this general class is disclosed by DE 42 00 020 C1 and the corresponding E 0 619 153 B1, wherein the pinion sector is disposed on the opposite side of the fixed hand lever. Consequently, the movable hand lever must reach beyond the casing and the guide, thereby improving the leverage ratio. The casing, the two hand levers and the expansion wedge are forged from high-strength steel, resulting in a relatively heavy tool. The frictional mating of steel with steel between the expansion wedge and the casing and guide results, despite lubrication, in a considerable requirement of effort which, in addition to the total weight, not only quickly tires the operator but also greatly stresses the teeth and the hand levers. Therefore breakage of the movable hand lever in the area between the pinion sector and hand lever has already been encountered whenever the operator has utilized the largest usable expansion head to expand other than soft pipe materials, after neglecting maintenance by regular lubrication. What is involved is a tool used mainly at construction sites and for repair purposes, in which maintenance is often neglected and misuse can occur.

Attempts have already been made to reduce the weight by using a light metal to make the casing and the hand lever incorporated therein and by joining a pinion sector of steel to a movable hand lever of a light metal. This combination, however, has not had a long useful life. The term, "light metal," as used herein, is to be understood to refer to aluminum as well as light metal alloys, especially high-strength aluminum alloys containing at least 60% aluminum by weight.

The invention, therefore, is addressed to the problem of providing a hand tool of the kind described above which, while serving the same purpose as the device according to DE 42 00 010 C1 and the corresponding EP 0 619 153 B1, requires significantly less effort in operation, has considerably less weight, and provides greater safety against overstressing the driving system and against the danger of breakage.

The solution of the stated problem is accomplished according to the invention in the hand tool named in the beginning by the features according to the present invention, which relates in part to hand tool for the expansion of hollow bodies having a casing with a first hand lever affixed to the casing and projecting laterally, with a second hand lever made of steel and which is joined pivotally with the casing on the side turned away from the first hand lever and which bears a pinion sector partially encompassing the shaft and is brought beyond the casing. The first hand lever and the second hand lever form a pliers. A through bore is arranged in the casing for the guidance of a rack consisting of steel, whose one end within the bore cooperates with the pinion such that an expansion wedge can be displaced by a closing movement of the two hand levers. The casing has means by which an expansion head with radially movable expander jaws can be placed coaxially onto the outwardly tapered end of the expansion wedge, wherein said casing with the bore and the first hand lever affixed to the casing comprise a material selected from the group consisting of plastics and light metals, wherein said casting and said rack together form a low-friction mating of light material with steel.

Thus the stated problem is solved to the full extent; in particular the device, while serving the same purpose as the device of DE 42 00 020 C1 and the corresponding EP 0 619 153 B1, requires decidedly less operating force on account of the frictional mating of steel with light metal, amounting to only about 12% of the former force. The saving of effort becomes especially apparent whenever an expansion is performed in stages or step-wise by replacing the expanding wedges in the pipe end, for example with wedges whose active surfaces are configured as cone sector surfaces or as stepped surfaces of decreasing diameters. Moreover a perceptibly lower weight of only about 50% of the former weight, and substantially less tiring of the operator due to the substantially reduced operating force, and greater safety against overstressing the drive system and against breakage. The efficiency amounts to more than 80%.

In comparison with the state of the art initially described, the following additional advantages are achieved: The expansion head is easily replaced. The expansion wedge is broadly supported on the side opposite the "bite" and is not flexurally stressed. No edge pressure is created at the end of the guide, no breakdown of the lubricant film occurs, and wear is reduced. The leverage ratio does not change. Expansion wedges of greater pitch with respect to the system's axis can be used, so that a greater expansion of plastic pipes of larger diameter, greater wall thickness and greater resistance to deformation. Moving the movable hand lever over an arcuate path becomes clearly better without exaggerated precision of the bearing, and also only one axis or pivot pin is needed. Standardized expansion wedges currently on the market can be used, with the insertion of an adapter in some cases.

In regard to the immense saving of the operator's effort and the effects on the drive system of the device, one must bear in mind the following synergistic effect: Due to the low operating effort, the internal surface stresses and friction forces are also reduced, so that the operating effort is reduced, and so on. This advantage promotes the use of the tool in all possible positions, overhead, with arms outstretched, etc.

Instead of light metal or a light metal alloy, an impact-resistant plastic can be used for the casing and the hand lever affixed to it, reinforced in some cases with embedded fibers, which is likewise a "light material" and has the same advantage of greatly reduced friction between the expansion wedge and the casing.

The term, "Leichtmetalle" [light metals] is defined, for example, in "RÖMPP CHEMIE LEXIKON," 9th ed., 1996, Vol. H–L, on page 2479. Aluminum, magnesium and titanium are cited as important industrially; also, alloys of light metals are considered to be "Leichtmetalle."

In the course of additional embodiments of the subject of the invention it is especially advantageous if—either individually or in combination:

The second hand lever, consisting with the pinion sector of steel, has two flanges between which at least one opening, hole or recess is situated on at least a part of its length, the second hand lever has at least three openings between which there are at least two bridges running lengthwise, the second hand lever has between the pinion sector and the portion containing the openings a wedge-shaped intermediate section at whose tapered extremity the pierced section is formed, the width of the flange is less than the width of the corresponding intermediate section, the width of the at least one bridge is again less than the width of the flange, the first hand lever, consisting with the casing of a light material, has two flanges between which at least one web exists along at least a portion of its length, the first hand lever has between the case and the end of the lever a wedgeshaped intermediate piece extending from the casing, at whose tapered end the remainder of that portion is formed, the width of the flange of the first hand lever is less than the width of the corresponding intermediate piece, the width of the at least one bridge in the first hand lever is again less than the width of the flange, the outer flanges of the hand levers are rounded in cross section on their outer sides and are provided at the ends of the hand levers with plastic sheaths whose outer sides are convergent, as seen from the system axis, when the levers are closed, the hand levers are curved toward one another saber-wise, the outsides of the intermediate pieces are convexly curved up to the edges which are at right angles to the system axis and cross at least substantially flush with the insides of the hand levers, the casing is of oval shape in cross section through the system axis, the expansion cone on the rack is made replaceable, between the casing and the expansion head a replaceable adapter is provided, which has an internal bore into which the upper end of the expansion wedge can be retracted under the guidance of the internal bore, and/or, if an adjusting screw is disposed in the casing, whereby the working angle of the movable second hand lever can be adjusted with respect to the casing, the radial expansion of the expander jaws can thus be controlled.

An embodiment of the invention and its manner of operation are further explained below with the aid of FIGS. 1 to 4.

DETAILED DESCRIPTION

Figure 1:
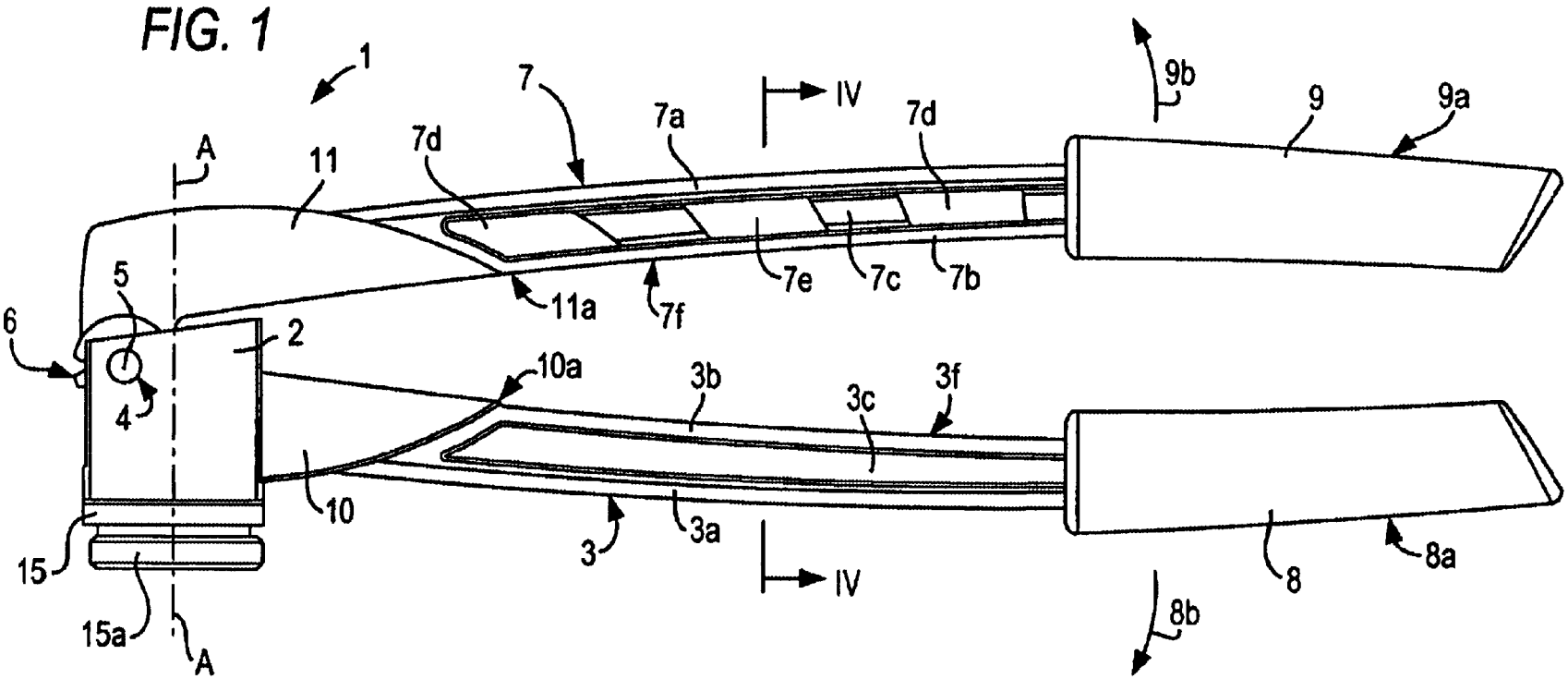
FIG. 1 is a side view of a complete expander pliers.
Figure 2:
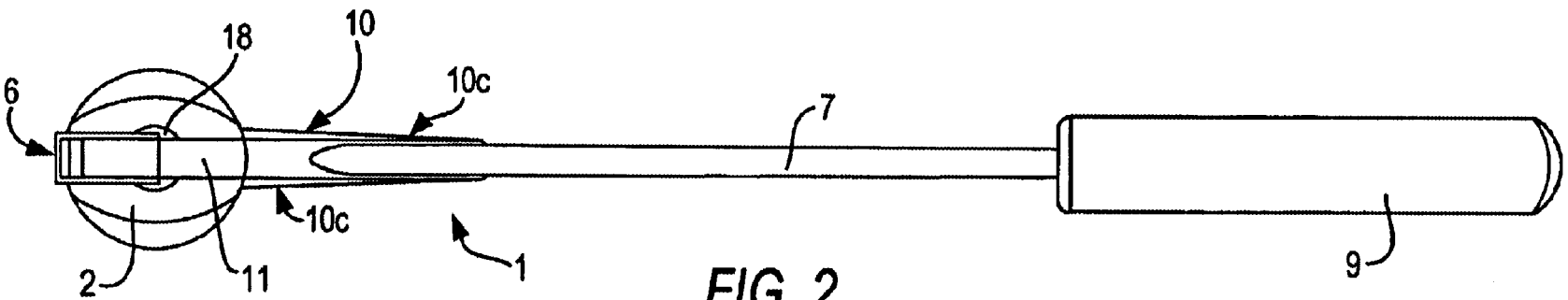
FIG. 2 is a top plan view of the expander pliers of FIG. 1.
Figure 3:
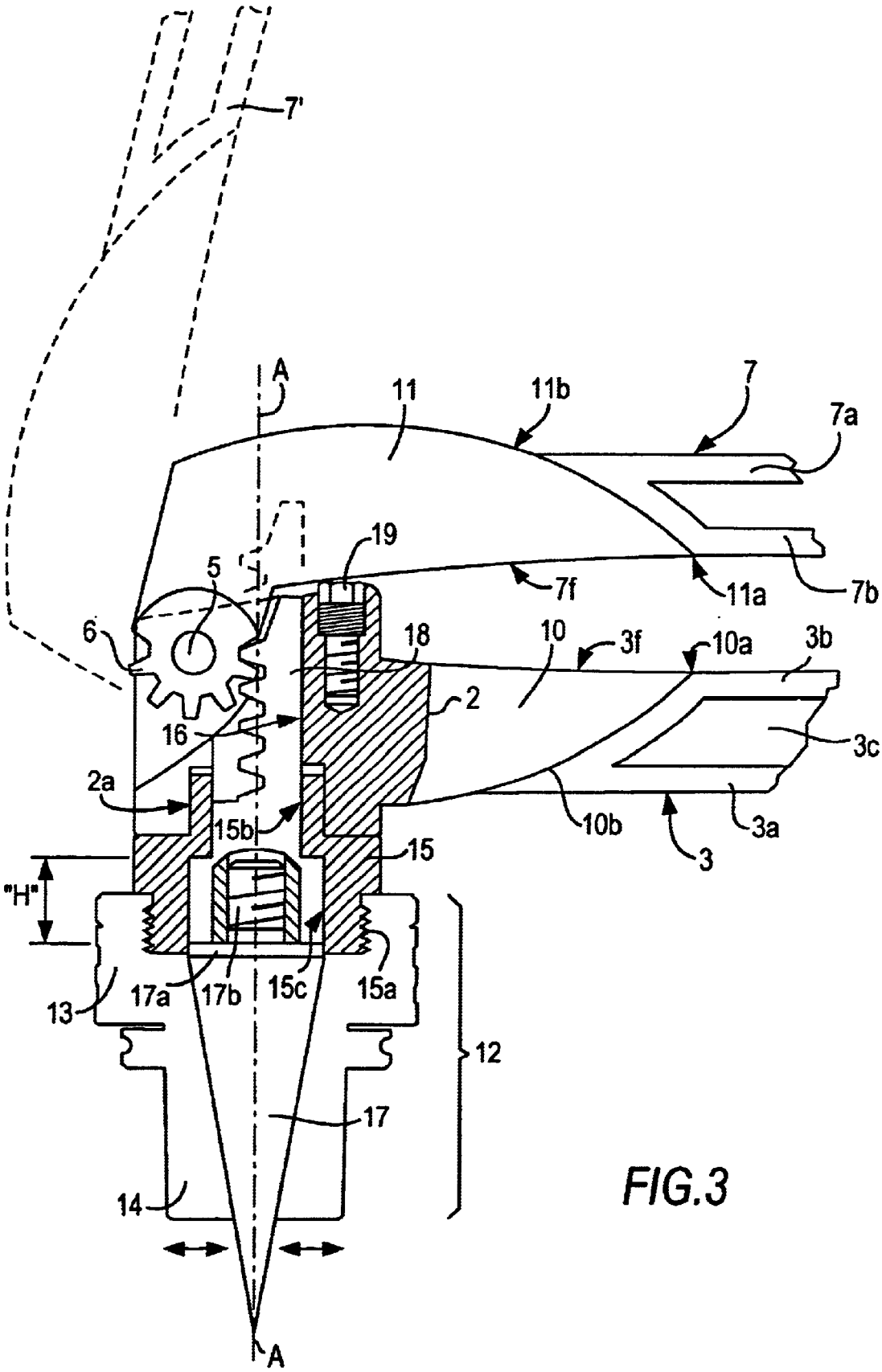
FIG. 3 is a partial axial section along axis A—A through the casing with expansion wedge, pinion sector and expansion head.

In FIGS. 1 and 2 an expander pliers 1 is represented, which has a casing 2 with an integrally formed first hand lever 3 made in one piece with the casing. In the casing 2 there are furthermore two pivot holes 4, of which only the front one is visible, and through which a shaft 5 of a pinion sector 6 made of steel passes, which is made in one piece with a second, movable hand lever 7 (FIG. 3). The hand levers 3 and 7 are represented in their terminal position, i.e., they are shown as close together as possible.

The casing 2 and the hand lever 3 formed thereon consist of a forged light metal, e.g., a hard aluminum alloy with a density of about D=2.7. The movable hand lever 7 consists, together with the pinion sector 6 formed thereon, of forged steel. The free ends of the hand levers 3 and 7 are provided with identical handgrips 8 and 9 made of impact-resistant plastic. The outer sides of the handgrips 8 and 9 converge toward their free ends, thus enhancing the ergonomics of the expansion pliers 1 when the hand levers 3 and 7 are in their widest open position after they are moved about the shaft 5 on a circular path in the direction of arrows 8*b* and 9*b*, which is shown in FIG. 3, partially in broken lines. The convergence of the hand levers 3 and 7 in the closed, end position is achieved by an arcuate or saber-shaped mirror-image symmetry, as shown in FIG. 1.

The transition from the casing 2 to the hand lever 3 takes place through a wedge-shaped intermediate piece 10 whose sides 10*c* taper toward the free end of the lever (FIG. 2) so as to save weight. The hand lever 7 is joined to the pinion sector 6 by a wedge-shaped intermediate piece 11. The width of the intermediate piece 11 (perpendicular to the plane of drawing) amounts to at least 80% of the axial length of the pinion sector 6. The intermediate piece 11 is defined laterally (parallel to the plane of drawing) by plane-parallel surfaces.

The hand lever 3 affixed to the casing has two flanges 3*a* and 3*b* which are joined together by a web 3*c*. The weight is thus reduced without impairing the moment of resistance of the hand lever 3. The movable hand lever 7, made of steel, has two flanges 7*a* and 7*b* which are joined together by two narrow webs 7*c*. Thus openings 7*d*, 7*e* and 7*g* are formed on both sides of these webs 7*c*. The width of the flanges 3*a* and 3*b*, and 7*a* and 7*b*, respectively, of the hand levers 3 and 7 is definitely less than the width of the intermediate pieces 10 and 11, the width being measured perpendicularly to the plane of drawing. Due to the open-work design of the hand lever 7 beyond the intermediate piece 11, its weight is reduced without impairing the moment of resistance of the hand lever 7. The number of webs 7*c* and thus the number of openings 7*d*, 7*e* and 7*g* can be varied if necessary.

Due to the wedge shape of the intermediate pieces 10 and 11, whose edges 10*a* and 11 a are pointing toward the free ends of the hand levers 3 and 7, allowance is made for the reduction of the flexural moments toward the lever ends and the weight is further reduced without reducing strength. The end edges 10*a* and 11*a* run perpendicular to the plane of drawing and to the system axis A—A.

The weight saving through light construction is one of the decisive criteria of the tool. Instead of a light metal or light metal alloy, an impact resistant plastic can easily be used, strengthened if necessary by fiber inserts. Especially in the case of the second hand lever 7 made of steel, a portion of the metal not needed for flexural strength is omitted insofar as possible.

Steel is used for the second hand lever only because this hand lever is made in one piece with the pinion sector.

Figure 4:
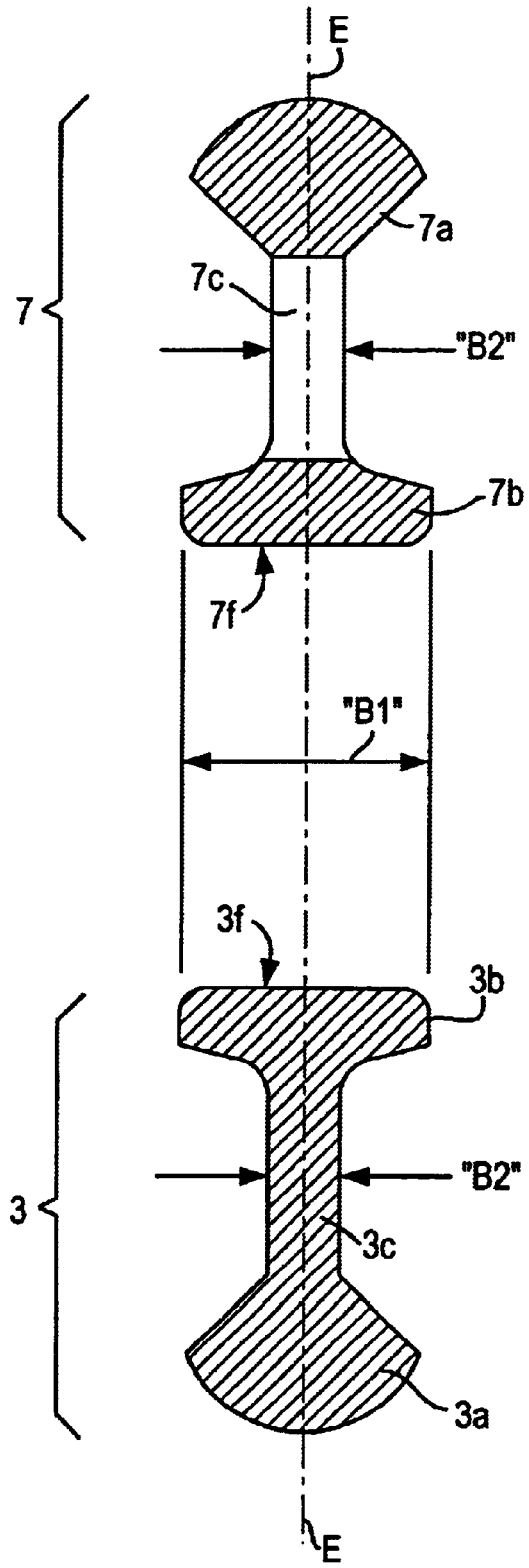
FIG. 4 is an enlarged section along line IV—IV of FIG. 1.

As shown in FIG. 4, in which the same reference numbers are used and a plane of symmetry E—E is shown, in which the plane of rotation of the movable hand lever 7 lies, the outer sides of the flanges 3*a* and 7*a* and the outsides 8*a* and 9*a* of the "slipped-on" hand grips 8 and 9 are well rounded. The width "B1" of the flanges 3*a* and 3*b* as well as 7*a* and 7*b* is less than the width of the intermediate pieces 10 and 11, and the width "B2" of the webs 3*c* and 7*c* is again definitely less than the width "B1". The portions of the hand levers 3 and 7 provided with the webs 3*c* and 7*c* have inner sides 3*f* and 7*f* which cross substantially flush with the end edges 10*a* and 11*a* of the intermediate pieces 10 and 11 described further above.

As FIG. 3 shows, an expansion head 12 is screwed onto the basic unit, consisting of the casing 2 with the expansion wedge 17 and the hand levers 3 and 7, and consists of a screw cap 13 and a set of expander jaws 14 which are displaceable radially in the direction of the two arrows by the axially moving, tapering expansion wedge 17, by means of which a pipe end can be expanded in one or more operations. In the position according to FIG. 1 and FIG. 3 (solid lines) the expander jaws 14 are situated in the farthest outspread position. The reverse movement is performed by turning the hand lever 7 upward. Such expansion heads 12, however, are known, so that further comment is unnecessary.

FIG. 3, using most of the same reference numbers, shows principally the internal construction of the expander pliers 1 according to FIGS. 1 and 2, with an adapter 15 with an external thread 15*a*, onto which the expansion head 12 is screwed, which here is indicated only schematically. For this purpose the casing 2 has an internal thread 2*a* into which the adapter 15 is screwed. The casing 2 has in its interior a cylindrical bore 16 as a precisely fitting guide for a rack 18 consisting of high-strength steel, which has a linear row of teeth only at the upper end, and the system axis A—A passes through the flanks of the teeth. The pinion sector 6 of the hand lever 7, which has already been described, and is journaled and guided between the bearing bores 4 (FIG. 1), meshes with the rack 18.

FIGS. 1 and 3 furthermore show that the intermediate pieces 10 and 11 have convexly curved outer edges 10*b* and 11*b* which run all the way to the end edges 10*a* and 11*a*, which in turn are at right angles to the system axis A—A and cross at least substantially flush with the inner sides 3*f* and 7*f* of the hand levers 3 and 7.

If the hand lever 7 is turned to position 7', represented in broken lines, the upper end of the rack 18 is raised by the distance "H" to the position shown in broken lines. It is important that the meshing of the teeth continues within the upper end of the bore 16, so that the guide is not subjected to edge pressure. The transverse forces produced by the meshing of the teeth and the flank angle thrust always against the side of bore 16 opposite the pinion sector. The friction forces, however, are extremely low due to the mating of steel with light metal and by the avoidance of edge pressure. By bringing the hand levers 7 and 3 together, an expansion process is performed and the parts are returned to the positions drawn in solid lines in FIG. 3.

The adapter 15 has an internal bore 15*b* which is aligned with the bore 16 of the casing 2, but has a slightly greater radial clearance from the rack 16 so as to avoid conflict between the bores 15*b* and 16 when other adapters 15 are used. Furthermore, the adapter 15 has an additional internal bore 15*c* in which the upper, cylindrical end 17*a* of the expansion wedge 17 is guided. Above the cylindrical end 17*a*, the expansion wedge 17 has a threaded stud 17*b* which is screwed into a corresponding concentric counter-thread in the lower end of the rack 18. By a selection of adapter 15 and expansion wedge 17, different expansions can be achieved.

The expansion wedge 17 is of conical (or truncated conical) shape and can be changed by means of the threaded connection 17*b*/18. Thus, and by selecting the appropriate adapter 15, an expansion wedge 17 with a larger or smaller base diameter (at 17*a*) or with a larger or smaller taper angle can be used, depending on the requirements of the expanding operation and the internal and external geometric shapes of the expansion head 12, especially the shape of the internal bearing surfaces of the expansion head 12 that can be fitted to the expansion wedge 17.

It is possible to design the hand lever 3, like the hand lever 7, with openings and bridges. Since hand lever 3, however, is made of a light metal any further weight reduction is of no great importance. FIG. 2 also shows that the casing 2—as seen in cross section across the axis A—A—is made substantially flat or oval, in order to achieve further weight reduction.

FIG. 3 also shows that an adjusting screw 19 is disposed in the casing 2, by which the angle of rotation of the hand levers 3 and 7 as they are closed can be varied and thus also the maximum expansion diameter can be adjusted by controlling the movement of the gear drive 6/18 and the expansion wedge 17.

What is claimed is:

1. A hand tool for the expansion of hollow bodies comprising a rack made of steel, a casing;

a first hand lever affixed to said casing and projecting laterally;

a second hand lever which consists of steel and is joined pivotally with the casing on a side turned away from the first hand lever and which bears a pinion partially encompassing a shaft and is brought beyond the casing such that the first hand lever and the second hand lever form pliers, the first hand lever having one or two flanges, wherein a through bore is arranged in the casing for the guidance of said steel rack, one end of said rack within the bore cooperates with the pinion such that an expansion wedge can be displaced by a closing movement of the first and second hand levers, the casing further comprising means by which an expansion head with radially movable expander jaws can be placed coaxially onto the outwardly tapered end of the expansion wedge, wherein said casing with the bore and the first hand lever affixed to the casing together comprise a light material selected from the group consisting of plastics and light metals lighter than steel, wherein said casing and said rack together form a low-friction mating of light material with steel.

2. The hand tool according to claim 1, wherein the second hand lever consisting with the pinion sector of steel has two flanges between which there is at least one opening on at least a portion of its length.

3. The hand tool according to claim 2, wherein the second hand lever has at least three openings between which at least two bridges are situated in the lengthwise direction.

4. The hand tool according to claim 2, wherein the second hand lever has between the pinion sector and a portion pierced portion by at least one opening a wedge-shaped intermediate piece overlapping the casing, and the pierced portion is formed on its tapered end.

5. The hand tool according to claim 4, wherein the width of the flange is less than the width of the corresponding intermediate piece.

6. The hand tool according to claim 5, wherein the width of the at least one bridge is again less than the width of the flange.

7. The hand tool according to claim 1, wherein the first hand lever together with the casing of a light material has two flanges between which a web is situated on at least a portion of its length.

8. The hand tool according to claim 1, wherein the first hand lever has a wedge-shaped intermediate piece extending from the casing and the remaining portion of the first hand lever following the wedge-shaped intermediate portion towards the hand grip is formed on a tapered end.

9. The hand tool according to claim 8, wherein the width of the flange of the first hand lever is less than the width of the corresponding intermediate piece.

10. The hand tool according to claim 9, wherein the width of the at least one bridge of the first hand lever is again less than the width of the flange.

11. The hand tool according to claim 1, wherein the hand levers have outer flanges that are rounded in cross section on their outer sides and are provided at the ends of the hand levers with slip-on hand grips of a plastic, whose outer sides are convergent, as seen from the system axis when the hand levers are in the closed position.

12. The hand tool according to claim 1, wherein the hand levers are curved saber-wise.

13. The hand tool according to claim 4, wherein the outer sides of the intermediate pieces are convexly curved up to their end edges which are at right angles to the system axis and cross at least substantially flush with the inner sides of the hand levers.

14. The hand tool according to claim 1, wherein the casing is of oval configuration in cross section to the system axis.

15. The hand tool according to claim 1, wherein the expansion wedge is disposed replaceably on the rack.

16. The hand tool according to claim 15, wherein between the casing and the expansion head a replaceable adapter is disposed, which has an internal bore into which the upper end of the expansion wedge, guided by the internal bore, can be retracted.

17. The hand tool according to claim 1, wherein in the casing an adjusting screw is disposed by which the angle of rotation of the movable second hand lever with respect to the casing and thus the radial expansion movement of the expander jaws is adjustable.

18. The hand tool according to claim 4, wherein the hand levers have outer flanges that are rounded in cross section on their outer sides and are provided at the ends of the hand levers with slip-on hand grips of a plastic, whose outer sides are convergent, as seen from the system axis when the hand levers are in the closed position.

19. The hand tool according to claim 9, wherein outer sides of the intermediate pieces are convexly curved up to their end edges which are at right angles to the system axis and cross at least substantially flush with the inner sides of the hand levers.

* * * * *